US006578498B1

(12) United States Patent
Draudt et al.

(10) Patent No.: US 6,578,498 B1
(45) Date of Patent: Jun. 17, 2003

(54) FURNITURE ACCESSORY KIT FOR PORTABLE COMPUTERS AND THE LIKE

(75) Inventors: Gregg R. Draudt, Stow, MA (US); William C. Stewart, Cambridge, MA (US); Andrew H. Carlson, Alexandria, VA (US); Russell P. Whitaker, Grand Rapids, MI (US); Mark D. Swets, Grand Rapids, MI (US); Joseph D. Ruedinger, Grand Haven, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/588,258

(22) Filed: Jun. 6, 2000

(51) Int. Cl.[7] ..... A47B 37/00

(52) U.S. Cl. ..... 108/50.02; 108/108; 108/147.17; 312/223.6; 248/71; 211/90.01; 70/58

(58) Field of Search ..... 108/50.01, 50.02, 108/108, 147.17, 147.11; 312/223.3, 223.6, 223.1, 245, 246, 247; 211/26, 94.01, 90.01, 90.02, 87.01; 52/36.4, 36.5; 248/71, 51, 52, 551; 70/58, 424, 427, 428, 430

(56) References Cited

U.S. PATENT DOCUMENTS

| | | | | | |
|---|---|---|---|---|---|
| 3,045,961 | A | | 7/1962 | Cygan | |
| D194,870 | S | | 3/1963 | Hill | |
| 3,154,281 | A | * | 10/1964 | Frank | 248/71 X |
| 3,601,256 | A | * | 8/1971 | Bowers, Jr. | 108/108 |
| 3,905,570 | A | * | 9/1975 | Nieuwveld | 248/71 |
| 3,983,822 | A | * | 10/1976 | Suttles | 108/108 |
| 4,008,872 | A | | 2/1977 | Thompson | |
| 4,053,701 | A | * | 10/1977 | Ogilvie et al. | 312/223.6 X |
| 4,598,504 | A | | 7/1986 | Itagaki | |
| 4,762,072 | A | * | 8/1988 | Boundy et al. | 108/50.02 |
| 4,792,881 | A | * | 12/1988 | Wilson et al. | 312/223.6 X |
| 4,805,784 | A | * | 2/1989 | Solheim et al. | 211/94.01 |
| D301,576 | S | | 6/1989 | Wang | |
| D302,938 | S | | 8/1989 | Fujioka | |
| 4,944,416 | A | | 7/1990 | Petersen et al. | |
| 4,961,295 | A | | 10/1990 | Kosch, Sr. et al. | |
| 5,040,752 | A | * | 8/1991 | Morrison | 248/71 |
| 5,142,832 | A | | 9/1992 | Branham, Sr. et al. | |
| 5,188,246 | A | * | 2/1993 | Maxworthy | 211/90.01 X |
| D350,939 | S | | 9/1994 | Rossman et al. | |
| D350,940 | S | | 9/1994 | Rossman et al. | |
| 5,375,802 | A | | 12/1994 | Branham, II | |

(List continued on next page.)

FOREIGN PATENT DOCUMENTS

| | | | | |
|---|---|---|---|---|
| DE | 3929654 | * | 3/1990 | 312/245 |
| WO | 93021799 | * | 11/1993 | 312/223.3 |

*Primary Examiner*—Lanna Mai
*Assistant Examiner*—Hanh V. Tran
(74) *Attorney, Agent, or Firm*—Price, Heneveld, Cooper, DeWitt & Litton

(57) ABSTRACT

A furniture accessory kit is designed to support portable computers in office partition systems of the type having slat wall panels on which detachable office amenities, such as paper trays, etc. can be hung. A horizontal shelf accessory supports a portable computer thereon, and includes a connector that detachably mounts the shelf to an associated slat wall panel in a cantilevered horizontal orientation. The shelf has a wire trough to mange wiring associated with the portable computer. A sleeve-shaped accessory unit with a hollow interior for retaining computer accessories therein is configured to be hung on the slat wall panel directly above the shelf. A wire management device to retain wires associated with the portable computer is configured to be hung on the slat wall panel near the shelf and the accessory unit. A security devices for securing the portable computer to the slat wall and which is configured to be hung on the slat wall panel near the shelf and the accessory unit. A power supply unit for supplying electrical power to the portable computer to the slat wall and which is configured to be hung on the slat wall panel near the shelf and the accessory unit.

18 Claims, 11 Drawing Sheets

U.S. PATENT DOCUMENTS

D366,865 S 2/1996 Stringer
5,640,301 A 6/1997 Roecker
D390,448 S 2/1998 Bries et al.
5,743,414 A * 4/1998 Baudino ..... 211/94.01 X
5,775,521 A 7/1998 Tisbo
5,853,236 A * 12/1998 Rogers et al. ..... 312/223.6
5,890,325 A * 4/1999 Corcoran et al. ..... 52/36.1
5,901,513 A * 5/1999 Mollenkopf et al. . 108/50.02 X
D411,735 S 6/1999 Bernard et al.
5,921,402 A * 7/1999 Magenheimer ..... 211/94.01 X
5,931,429 A * 8/1999 Hellwig et al. ..... 108/108 X
5,941,026 A 8/1999 Eisenreich et al.
6,006,557 A * 12/1999 Carl et al. ..... 70/58

* cited by examiner

FURNITURE ACCESSORY KIT FOR PORTABLE COMPUTERS AND THE LIKE

BACKGROUND OF THE INVENTION

The present invention relates to a plurality of amenity units removably mountable on a slat wall, and in particular to shelving units, electrical and communication line organizers, security devices, and power supply units removably mountable on a slat wall.

As the cost for office space increases, companies continue to seek ways to make use of limited space, and also of those spaces within a given work area heretofore unutilized. This task is made increasingly difficult as the amount of computer and communication equipment required by the average worker increases.

The increase in equipment required by the average worker has led to additional problems such as providing convenient routing of electrical and communication lines associated with the computers and communication equipment, while maintaining an aesthetically appealing work area. In many work environments these lines are left laying across the floor and dangling from worksurfaces, thereby creating a disorganized work area.

SUMMARY OF THE INVENTION

An aspect of the present invention is to provide within a partition system for dividing open office space and the like of the type having at least one slat wall panel with a plurality of vertically spaced apart horizontal rails to detachably support office accessories thereon, the improvement of a wall-hung accessory kit for portable computers including a horizontal shelf member shaped to abuttingly support a portable computer on an upper surface thereof. The horizontal shelf including a connector detachably mounting the shelf member to the slat wall panel in a cantilevered horizontal orientation, and a wire trough extending laterally along the shelf member adjacent the rear edge thereof, and shaped to receive and retain therein wiring associated with the portable computer.

Another aspect of the present invention is to provide in a partition system for dividing open office space and the like of the type having at least on slat wall panel with a plurality of vertically spaced apart horizontal rails to detachably support office accessories thereon, the improvement of a wall-hung portable computer support shelf including a horizontal shelf member shaped to abutting support a portable computer on an upper surface thereof. The computer support shelf also including a connector member detachably mounting the shelf member to the slat wall panel along a rear edge of the shelf member to support the same from the slat wall panel in a cantilevered horizontal orientation. The computer support shelf further including a wire trough extending laterally along the shelf member adjacent the rear edge thereof, and shaped to receive and retain therein wiring associated with the portable computer, and a removable cover shaped to enclose the wire trough and being detachably connected with the shelf member to provide access to the wire trough.

Another aspect of the present invention is to provide a shelf removably mountable on a slat wall, including a worksurface defining a top surface configured to support a laptop computer thereon, a bottom surface, a first side edge, a second side edge, a front edge, and a rear edge, and at least one mounting member attached along the rear edge of the worksurface and releasably mountable to a slat wall. The shelf further includes a recessed area located within the top surface of the worksurface, and which is adapted to receive electrical and communication lines therein, and a top cover movable between a closed position, wherein the top cover covers the recessed area and is substantially planar with the top surface, and an open position wherein the recessed area is accessible.

Yet another aspect of the present invention is to provide a shelf removably mountable on a slat wall, that includes a housing that includes a first wall, a second wall, a third wall and a fourth wall, wherein the walls are connected to define at least one open end allowing access to an interior of the housing. The shelf also includes a first mounting member connected to the first wall of the housing, and removably mountable to a slat wall, thereby supporting the housing from the slat wall in a first orientation, and a second mounting member connected to the second wall of the housing, and removably mountable to a slat wall, thereby supporting the housing from the slat wall in a second orientation.

Another aspect of the present invention is to provide an apparatus removably mountable to a slat wall for managing electrical and communication lines and the like, that includes a loop section adapted to receive electrical and communication lines therethrough, a stem section fixedly attached to the loop section, and a plurality of flexible fingers connected to the stem and adapted to releasably engage a slat wall, thereby supporting the loop from the slat wall.

Yet another aspect of the present invention is to provide an apparatus removably mountable to a slat wall for managing electrical and communication lines, that includes a first plate, a second plate, and a narrowed center section connected to and extending between the first and second plates, such that the first and second plates are substantially parallel to one another, and wherein the center section is adapted to windingly receive electrical and communication lines thereabout. The apparatus further includes a plurality of flexible fingers connected to the first plate and adapted to releasably engage the slat wall.

Another aspect of the present invention is to provide a kit for securing a device to a slat wall, that includes a first member including a ring section defining an aperture therein, a stem section extending outwardly from the ring section, and a pair of flanges connected to the stem section and engagable with a slat wall by inserting the flanges within a slot of the slat wall and rotating the first member. The kit also includes a second member including a plate section defining an inner surface and an outer surface and having an elongated aperture located therein, wherein the aperture is adapted to receive the ring section of the first member therein, and at least one stop extending outwardly from the inner surface of the plate section and adapted to engage the slat wall, thereby restricting rotational movement of the first member and the second member. The kit further includes a third member adapted to be received within the ring section of the first member, thereby preventing removal of the plate of the second member from about the ring section of the first member.

Still yet another aspect of the present invention is to provide a power supply box removably mountable on a slat wall, that includes a housing and at least one power outlet, and at least one mounting bracket attached to the housing and adapted to releasably engage a slat wall, thereby supporting the housing on the slat wall.

The plurality of amenity units disclosed herein, taken separately and as a whole, provide an effective means for organizing compact work areas by utilizing areas previously unutilized. Further, the plurality of amenity units are adaptable to numerous work area layouts and are effective in creating and maintaining an aesthetically pleasing and efficient work area.

These and other advantages of the invention will be further understood and appreciated by those skilled in the art by reference to the following written specification, claims and appended drawings.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention as oriented in FIGS. 1, 7, 10, 12 and 14. However, it should be understood that the invention may assume various alternative orientations and step sequences, except where expressly specified to the contrary. It should also be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly stated otherwise.

Figure 16:
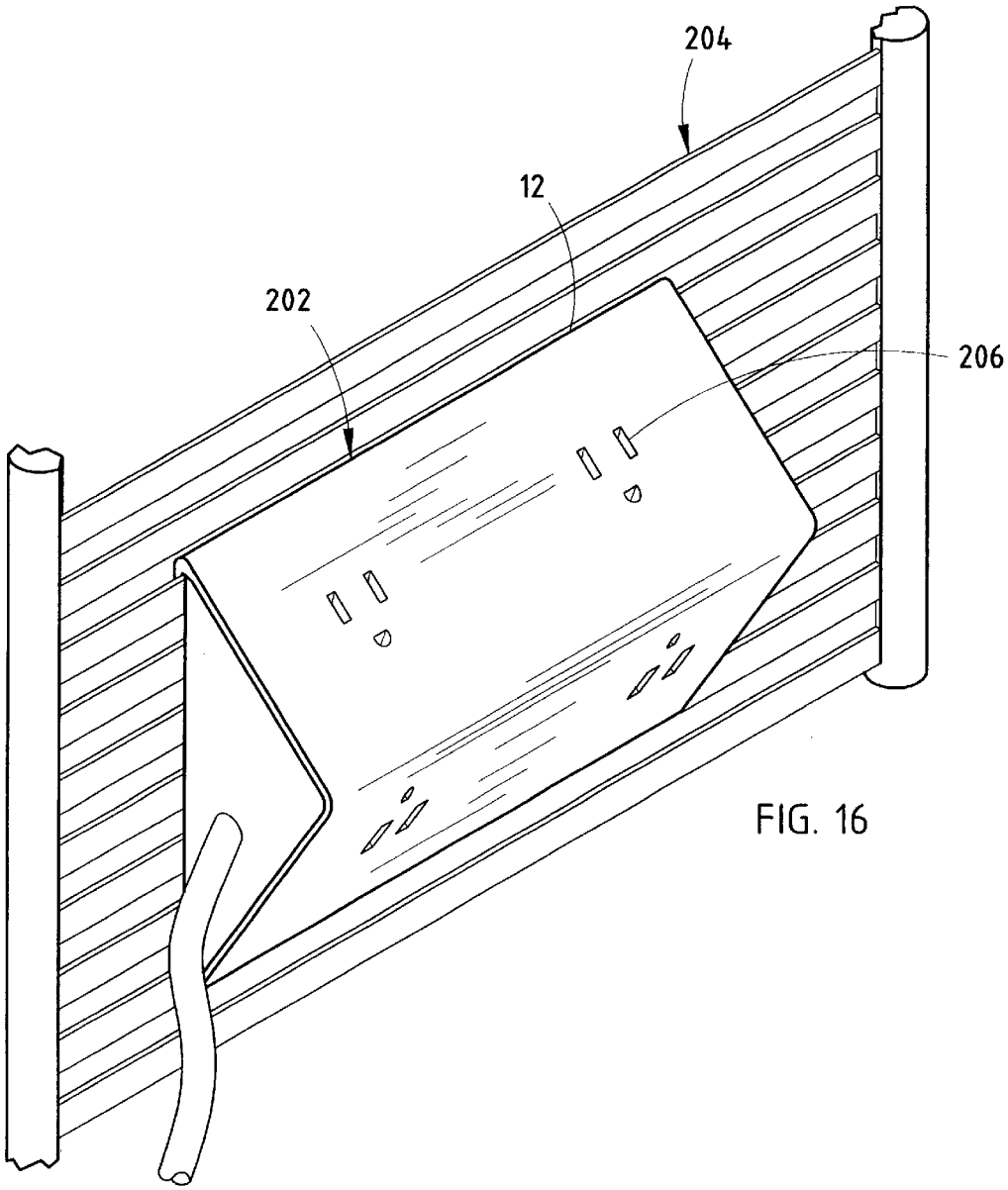
FIG. 16 is a perspective view of a power supply box embodying an amenity unit of the present invention supported by the slat wall.

The present invention provides within a partition system for dividing open office space and the like of the type having at least one slat wall panel, general designated 12 (FIG. 1), with a plurality of vertically spaced apart horizontal rails to detachably support an accessory kit for portable computers including a horizontal shelf member 10, a sleeve-shaped accessory support 90 (FIG. 7), a first wire management device 130 (FIG. 10), a second wire management device 144 (FIG. 12), a security device 170 (FIG. 14), and a power supply unit 202 (FIG. 16), each of which are described below.

Figure 1:
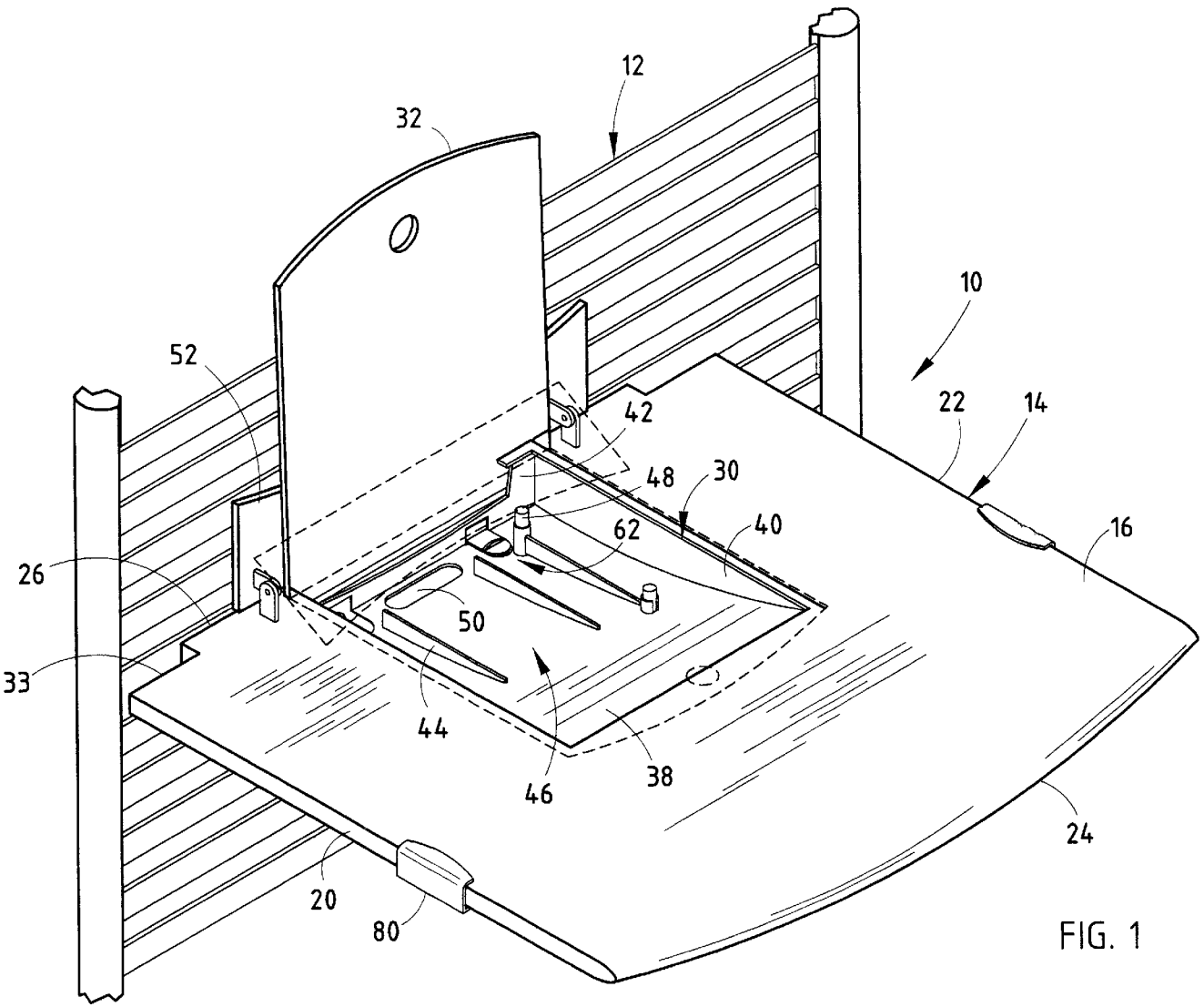
FIG. 1 a perspective view of a first shelving unit embodying an amenity unit of the present invention, supported by a slat wall, and showing a top door in an open position and in a closed position, and a rear door in an open position and in a closed position.
Figure 2:
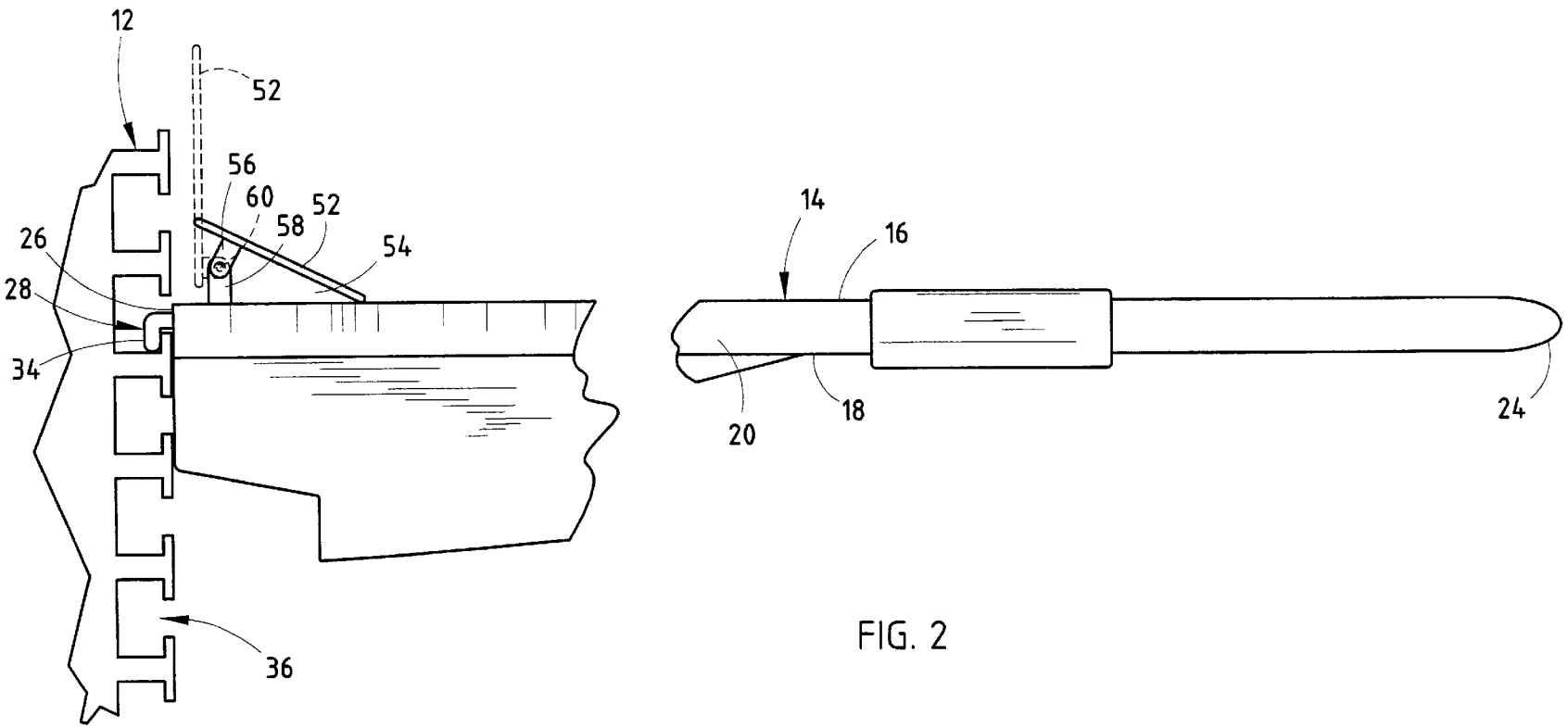
FIG. 2 is a side elevational view of the first shelving unit.

In the illustrated example, the first shelving unit 10 (FIG. 1) is mountable on a slat wall 12, and includes a worksurface or shelf member 14 defining a top surface 16 configured to support a portable or laptop computer (not shown) thereon, a bottom surface 18 (FIG. 2), a first side edge 20, a second side edge 22, a front edge 24 and a rear edge 26. The first shelf unit 10 also includes at least one mounting or connector member 28 attached along the rear edge 26 of worksurface 14 and releasably mountable to the slat wall 12, and a recessed area or wire trough 30 located within the top surface 16 of worksurface 14 and adapted to receive electrical and communication lines (not shown) therein. The first shelving unit 10 further includes a top cover 32, movable between a closed position, wherein the top cover 32 covers recessed area 30 and is substantially planar with top surface 16, as shown in FIG. 1 in phantom line, and an open position, wherein the recessed area 30 is accessible.

Figure 3:
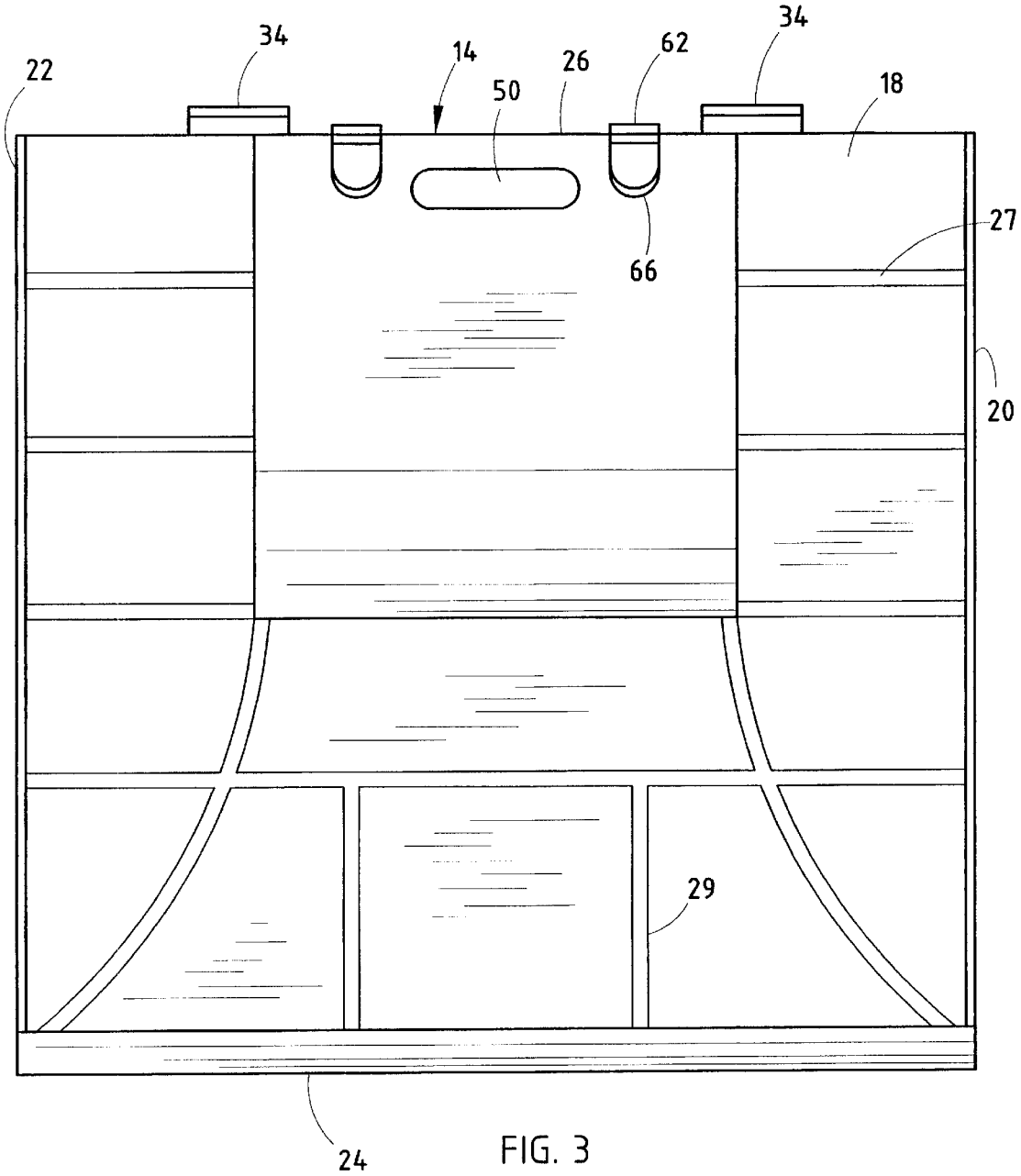
FIG. 3 is a bottom plan view of the first shelving unit.

The worksurface 14 is formed by compression molding and is manufactured as a single piece, however, other manufacturing processes and configurations may be used. The worksurface 14 is configured to support a device such as a laptop computer thereon, however, worksurface 14 may be used to support other devices and objects thereon. In use, the top cover 32 is placed in a closed position over recessed area 30 thereby allowing the entire top surface 16 of worksurface 14 to be utilized in supporting the computer or other devices thereon. Top surface 16 is configured so as to provide adequate area for supporting the laptop computer thereon, and for manipulating a mouse thereon, while limiting the overall size, thereby providing effective support and allowing effective operation of the computer within a small work space area. Top surface 16 is slightly curved near front edge 14, thereby providing an ergonomically shaped surface for an operator to rest his or her palms or wrists upon during manipulation of the mouse and operation of the keyboard of the computer. Rear edge 26 of worksurface 14 is provided with a pair of laterally extending notches 33 configured to allow the routing of the electrical and communication lines therethrough. Worksurface 14 (FIG. 3) is molded to include a plurality of integrally molded laterally extending structural support ribs 27 and a plurality of longitudinally extending structural support ribs 29 downwardly extending from bottom surface 18.

The mounting member 28 includes a pair of L-shaped brackets 34 attached to and extending along rear edge 26 of worksurface 14. Bracket 34 can be integrally molded within worksurface 14, or, alternatively, may be formed of a separate material such as metal and subsequently inmolded within worksurface 14. The worksurface 14 is supported from slat wall 12 by inserting bracket 34 into engagement within a slot 36 of slat wall 12, and subsequently sliding worksurface 14 and hence brackets 34 downwardly until brackets 34 engage slat wall 12.

As illustrated, top door 32 is pivotally attached to worksurface 14 by a pair of pivot pins (not shown) extending outwardly from top door 32 and which are pivotally received within a pair of corresponding apertures (not shown) located within worksurface 14. Although top door 32 is shown as being pivotable between an open and closed position, top door 32 may alternatively rest within a recessed rim 51 surrounding recessed area 30, and not be attached to worksurface 14. Further, worksurface 14 may be configured to include locking tabs (not shown) that hold top cover 32 in position over recessed area 30, and which allow top cover 32 to be slidingly movable between a locked position wherein the cover cannot be removed from covering recessed area 30, and an unlocked position wherein the cover can be removed from covering recessed area 30.

The recessed area 30 is defined by a curved bottom wall 38, side walls 40 and a rear wall 42. The recessed area 30 includes a plurality of vertically oriented ribs 44 extending upwardly from bottom wall 38. Ribs 44 extend longitudinally along bottom wall 38 and are spaced across recess area 30, thereby defining wire management spaces 46 therebetween. Electrical and communication lines (not shown) typically associated with an electronic device such as the computer noted above, may be organized about ribs 44 and within spaces 46, thereby compactly and neatly retaining the lines within recessed area 30. Recessed area 30 further includes a plurality of pins 48 spaced about recessed area 30 and extending upwardly from bottom wall 30. Pins 48 are configured and located so as to allow wrapping of electrical and communication lines thereabout, thereby allowing organized storage of the electrical and communication lines within recessed area 30. Pins 48 are specially adapted to allow organization of fiber optic lines and other communication lines that cannot be folded or creased without damaging the lines. Bottom wall 38 of recessed area 30 includes an elongated aperture 50 adapted to allow the placement of the electrical and communication lines therethrough.

The first shelving unit 10 further includes a rear cover 52 extending along rear edge 26 of worksurface 14. Rear cover 52 is movable between a closed position wherein rear cover 52 forms a pocket 54 with worksurface 14, and an open position wherein pocket 54 is accessible, as shown in phantom line in FIGS. 1 and 2. Pocket 54 is adapted to receive the routing of the electrical and communication lines therethrough. The electrical and communication lines are concealed from view within pocket 54 when rear cover 52 is in a closed position, while allowing easy access to the electrical and communication lines when rear cover 52 is in the open position. Rear cover 52 includes pivot tabs 56 extending downwardly from a surface thereof. A pair of corresponding pivot tabs 58 are connected to and extend upwardly from top surface 16 of worksurface 14. A pair of pivot pins 60 pivotally connect pivot tabs 56 of rear cover 52 and pivot tabs 58 of worksurface 14, thereby pivotally connecting rear cover 52 with worksurface 14.

Figure 4:
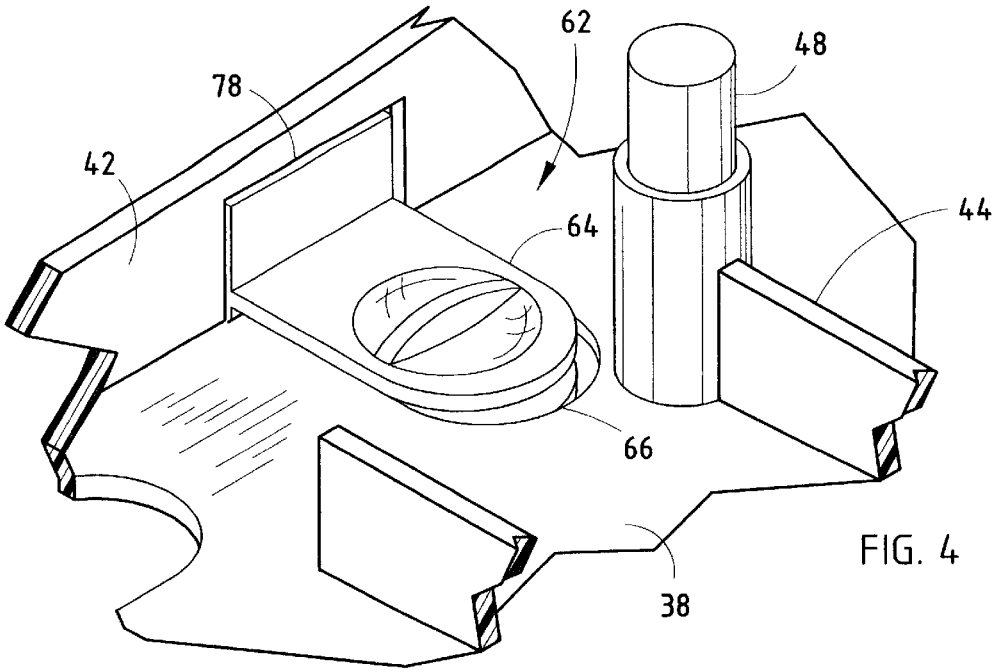
FIG. 4 is a fragmentary perspective view of a locking mechanism of the first shelving unit.
Figure 5:
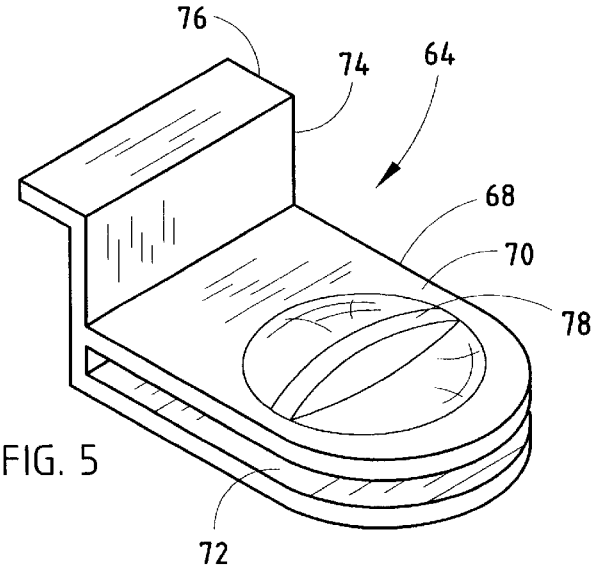
FIG. 5 is a perspective view of a sliding lock of the locking mechanism.

The first shelving unit 10 further includes a locking mechanism 62 (FIG. 4) that includes a pair of tabs 64 slidably engaged within a pair of slots 66 within bottom wall 38 of recessed area 30. Tabs 64 (FIG. 5) include a first portion 68 having a top surface 70 and a slot 72, a second portion 74 extending perpendicularly upward from first portion 68, and a third portion 76 extending perpendicularly rearward from second portion 74. Rear wall 42 of recessed area 30 is provided with an aperture 78 configured to allow passage of tab 64 therethrough. In assembly, tab 64 is inserted within aperture 78 of rear wall 42 and slidably engaged within slots 66 of bottom wall 38 such that bottom wall 38 is positioned within slot 72 of each tab 64. Top surface 70 of each tab 64 is provided with an upwardly extending tab 78, thereby allowing easy manipulation of tab 64 within slot 66. Prior to mounting of first shelving unit 10 upon slat wall 12, tabs 64 are slid forwardly within slots 66 until third portion 76 of each tab 64 does not extend rearwardly beyond rear wall 42 of recessed area 30. Subsequent to mounting first shelving unit 10 upon slat wall 12 by brackets 34, each tab 64 is slid rearwardly within slots 66 until third portion 76 of each tab 64 is engaged within slot 36 of slat wall 12, thereby preventing removal of first shelving unit 10 from support upon slat wall 12. Slot 72 of each tab 64 is sized so as to provide a frictional lock between bottom wall 38 and tabs 64.

Figure 6:
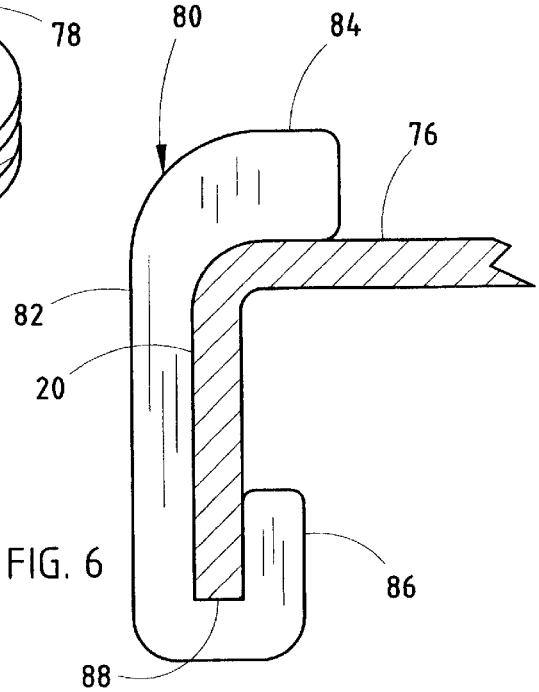
FIG. 6 is an end view of a sliding dog of the first shelving unit engaging an edge of a worksurface.

First shelving unit 10 further includes a pair of sliding dogs 80 slidably engaging first side edge 20 and second side edge 22 of worksurface 14. Each sliding dog 80 (FIG. 6) includes a central body portion 82 configured to track along the corresponding side edge 20 or 22, a top section 84 extending perpendicularly from body section 82 and configured to track along top surface 16, and a C-shaped bottom section 86 that extends around a bottom edge 88 of the corresponding side edge 20 or 22 and which is adapted to track therealong. Sliding dogs 80 limit the lateral movement of the computer or other device supported by worksurface 14, thereby limiting the chances of the device being pushed or pulled off the worksurface 14 and in a lateral direction. The sliding adjustability of sliding dogs 80 allows sliding dogs 80 to be moved out of the way of ports or passages, such as CD or disk drives, of the computer or other device.

Figure 7:
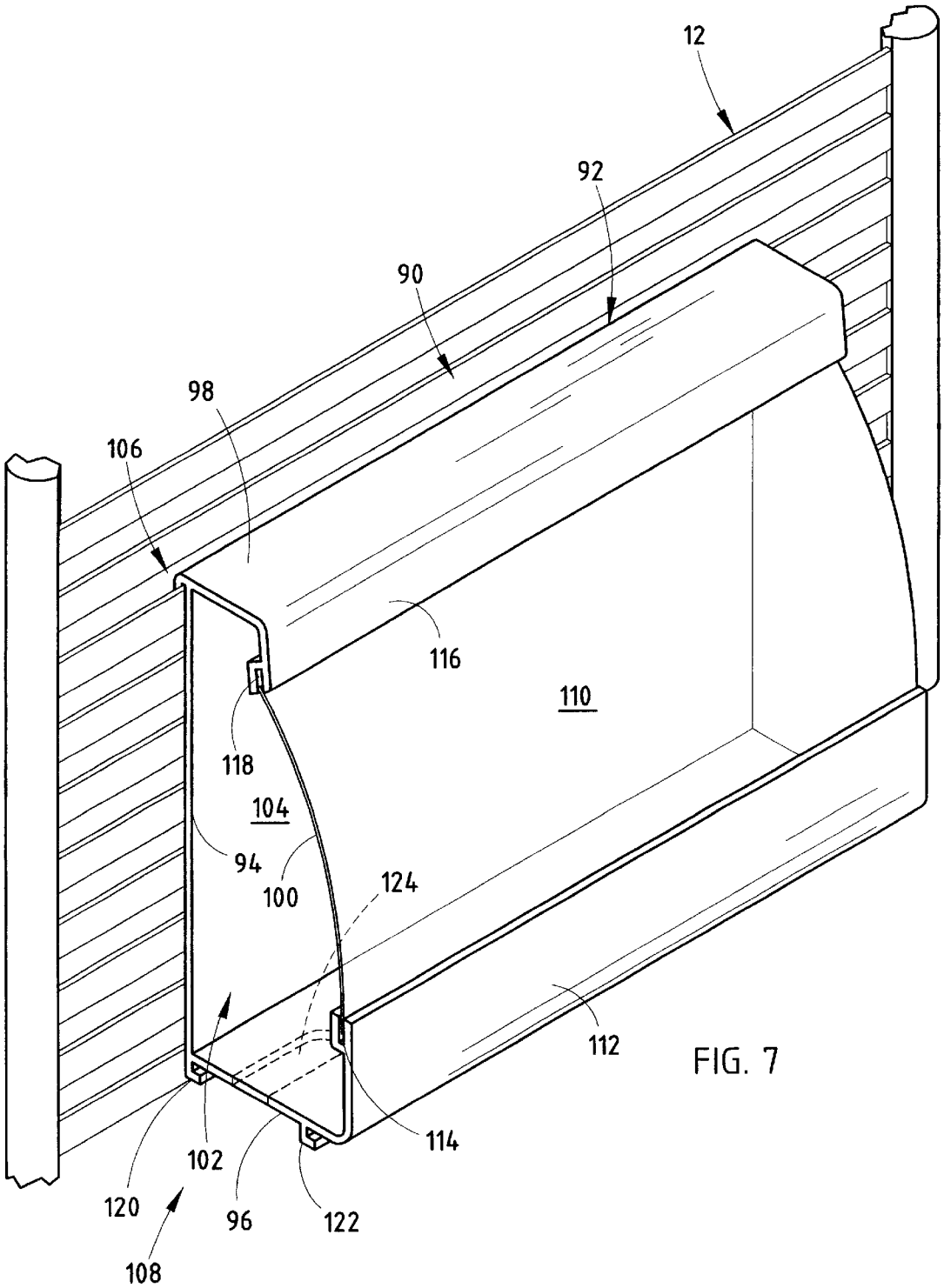
FIG. 7 is a perspective view of a second shelving unit embodying an amenity unit of the present invention, and supported by the slat wall in a first orientation.
Figure 8A:
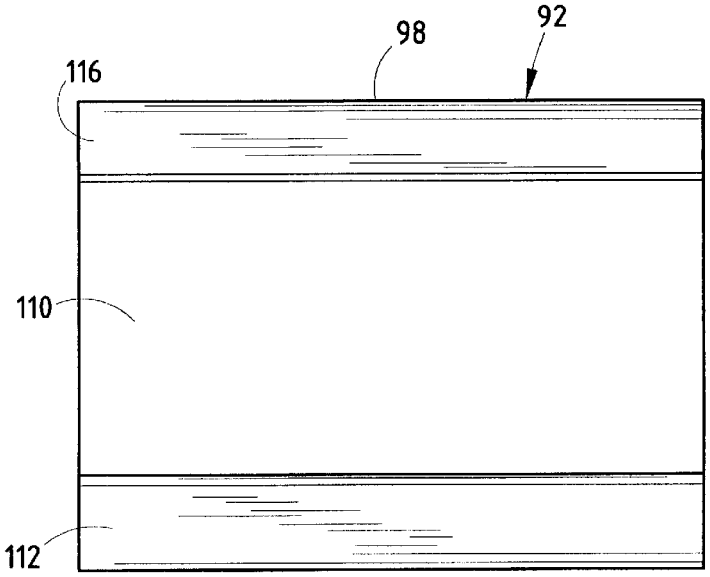
FIG. 8A is a elevational view of the second shelving unit.
Figure 8B:
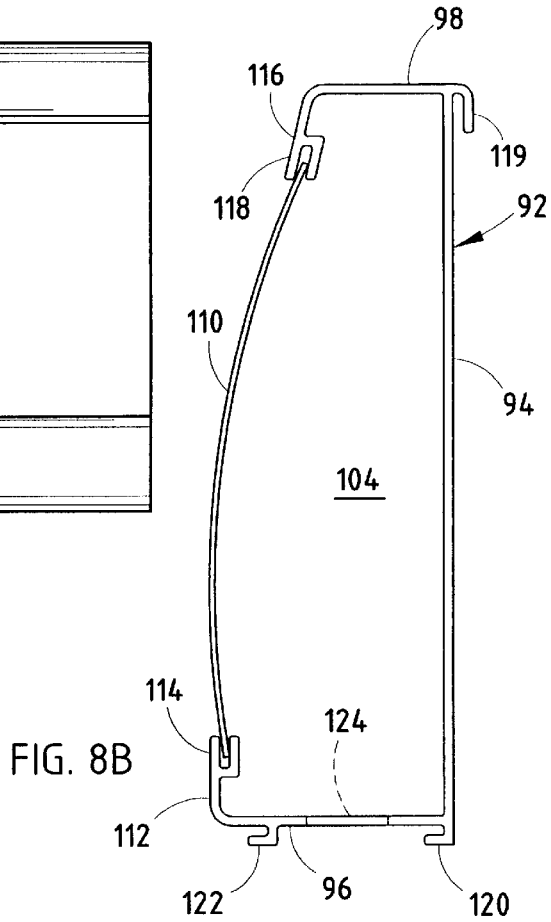
FIG. 8B is a side elevational view of the second shelving unit.
Figure 8C:
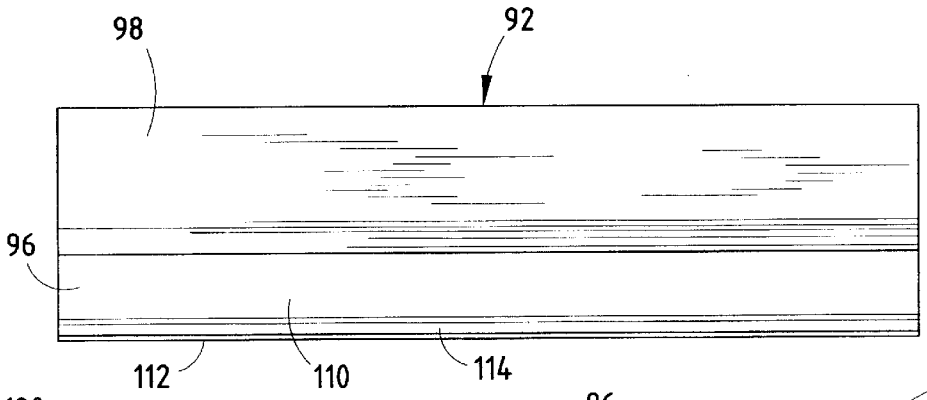
FIG. 8C is a top plan view of the second shelving unit.
Figure 8D:
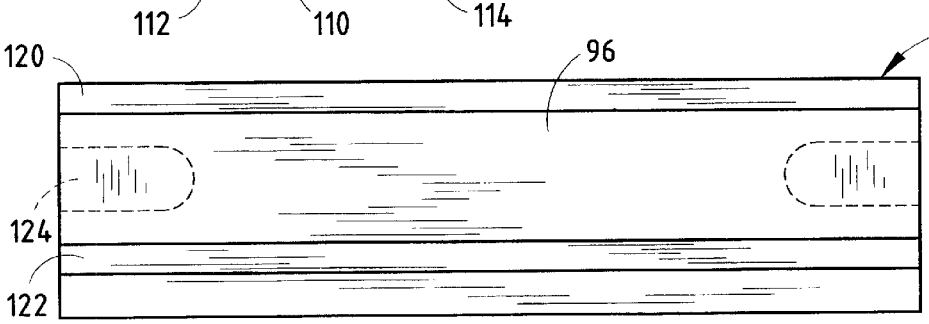
FIG. 8D is a bottom plan view of the second shelving unit.
Figure 9:
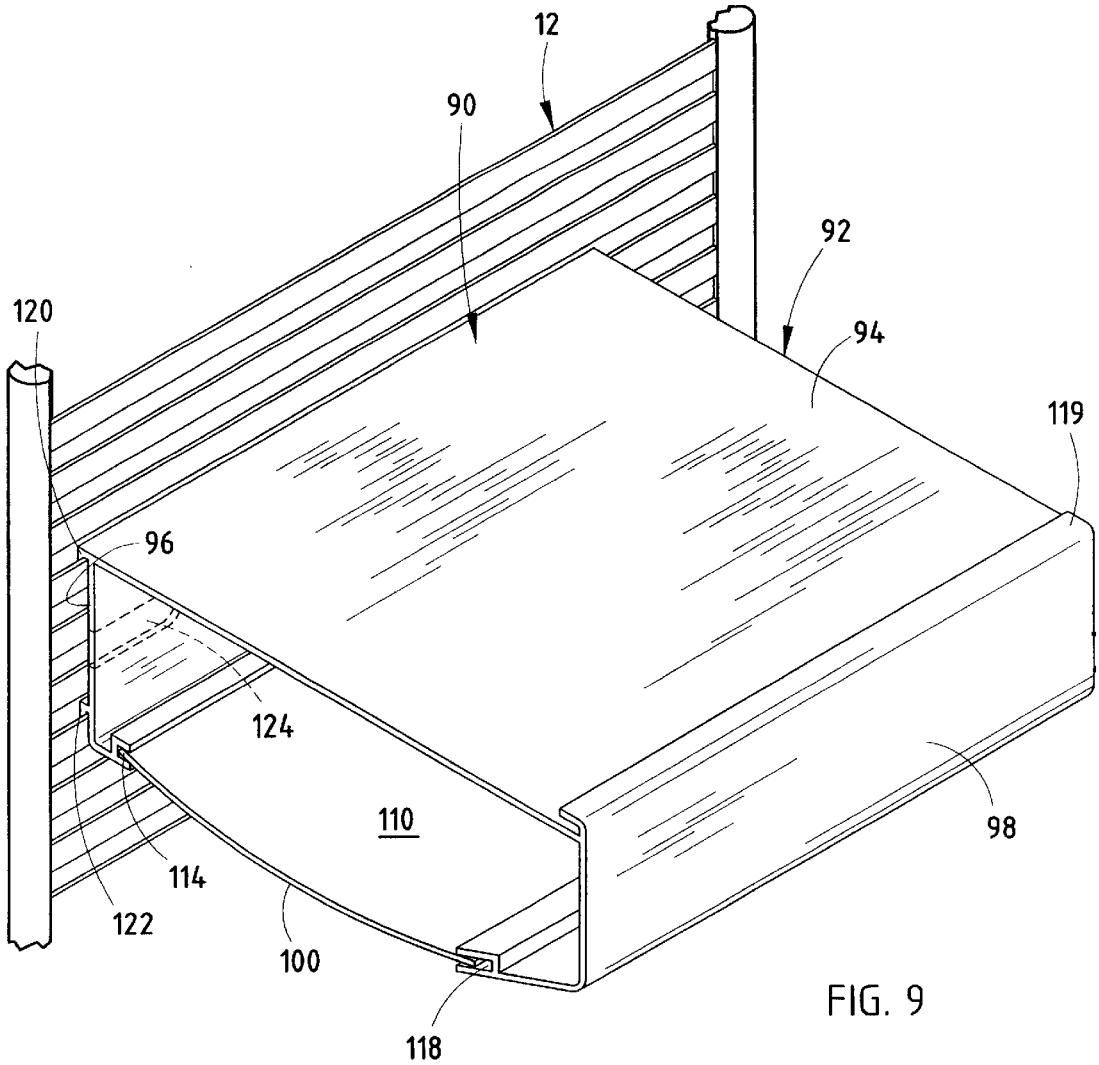
FIG. 9 is a top perspective view of the second shelving unit attached to the slat wall in a second orientation.
Figure 10:
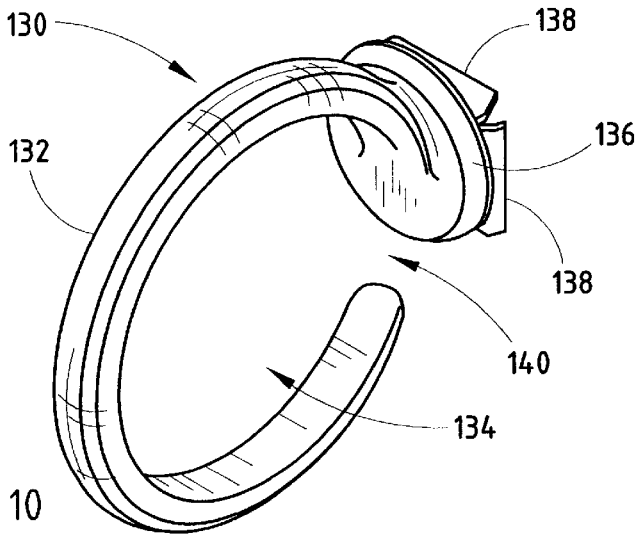
FIG. 10 is a perspective view of a wire management device embodying an amenity unit of the present invention.

As illustrated, the sleeve-shaped second shelving unit 90 (FIG. 7) embodies an amenity unit of the present invention. In the illustrated example, second shelving unit 90 is supported by the slat wall 12 and includes a housing 92 that includes a first wall 94, a second wall 96, a third wall 98, and a fourth wall 100. The walls 94, 96, 98 and 100 are connected to define at least one open end 102, allowing access to an interior 104 of housing 92. The second shelving unit 90 also includes a first mounting member 106 connected to first wall 94 of housing 92, and that is removably mountable to slat wall 12, thereby supporting housing 92 from slat wall 12 in a first orientation as shown in FIG. 7. The second shelving unit 90 further includes a second mounting member 108 connected to second wall 96 of housing 92, and that is removably mountable to slat wall 12, thereby supporting housing 92 from slat wall 12 in a second orientation as shown in FIG. 9.

The fourth wall 94 of housing 92 includes a removable panel 110 which is slidably engaged within fourth wall 100. More specifically, fourth wall 100 includes a partial lower wall 112 having a upwardly opening, laterally extending channel extending along an upper edge thereof, and a partial upper wall 116 having a downwardly opening laterally extending channel 118 extending along a lower edge thereof. Panel 110 is slidingly received within channels 114 and 118. Panel 110 is slightly wider than the distance between channel 114 and 118, thereby causing panel 110 to slightly bend when inserted within channels 114 and 118 and holding panel 110 between channels 114 and 118. As illustrated, second wall 96 is slightly wider than third wall 98, however, various widths may be used for second wall 96 as well as third wall 98 while still maintaining the functional purpose of second shelving unit 90. In the illustrated example, panel 110 is show to be transparent, however, panel 110 may be constructed of either a transparent, translucent or opaque material.

The first mounting member 106 includes an L-shaped flange 119 laterally extending along first wall 94 near third wall 98. Flange 119 is adapted to be received within and connect to slat wall 12, thereby supporting second shelving unit 90 from slat wall 12 in the first orientation. The second mounting member 108 includes an L-shaped flange 120 laterally extending along second wall 96 near first wall 94, and a flange 122 laterally extending along second wall 96 near fourth wall 100. Flange 120 and flange 122 are adapted to be received within and connect to slat wall 12, thereby supporting second shelving unit 90 from slat wall 12 in the second orientation.

Second wall 96 of housing 92 includes a pair of slots 24 adapted to receive electrical and communication lines therein as are shown in phantom line in FIGS. 7, 8B, 8D and 9.

The reference 130 (FIG. 10) generally designates an apparatus for managing electrical and communication lines and the like embodying an amenity unit of the present invention. In the illustrated example, the wire management apparatus 130 (FIGS. 11A and 11B) is removably mountable to slat wall 12 wire management and includes a loop section 132 that defines a passage 134 therein which is adapted to received electrical and communication lines typically associated with computer and communication equipment therethrough. Wire management apparatus 130 also includes a stem section integrally formed with loop section 132. As illustrated, stem section 136 is provided a plate-like shape and is integrally formed with loop section 132, however, stem section 136 may be provided in numerous geometrical shapes and may be formed as a separate piece from loop section 132 and then fixedly attached thereto. Wire management apparatus 130 further includes a plurality of flexible fingers 138 connected to stem section 136 and adapted to releasably engage slat wall 12, thereby supporting loop 132 from slat wall 12.

Loop section 132 includes a gap 140 therein, which is adapted to allow placement of the electrical and communication lines within passage 134 of loop section 132 without necessitating the stringing of the lines through loop section 132. Gap 140 allows the addition and removal of wires from within passage 134 of loop section 132 without necessitating the removal of wire management apparatus 130 from slat wall 12. Further, loop section 132 is constructed of a flexible material, thereby allowing gap 140 to be increased in size, thereby assisting in the placement of the lines within passage 134 of loop section 132.

Figure 11A:
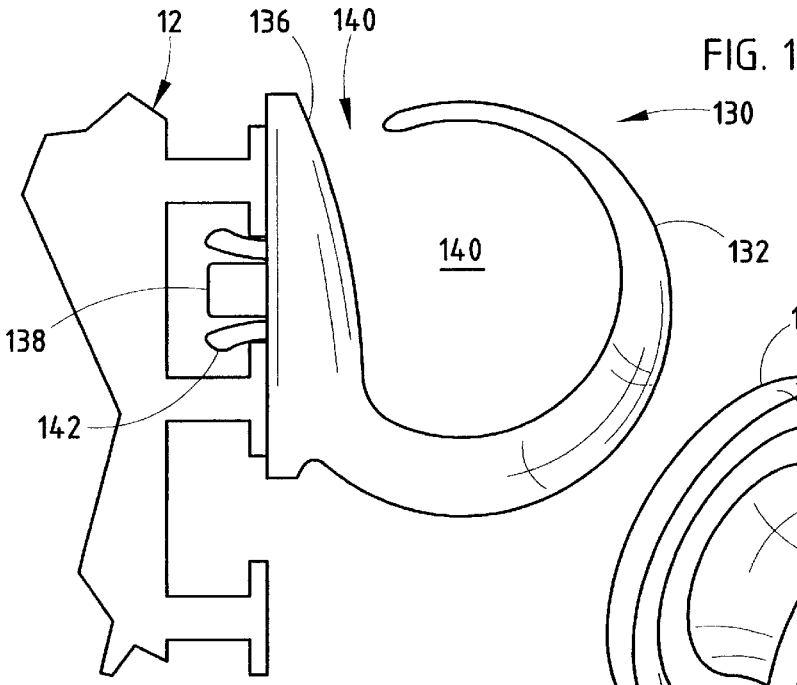
FIG. 11A is a side elevational view of the first wire management device supported by the slat wall in a vertical orientation.
Figure 12:
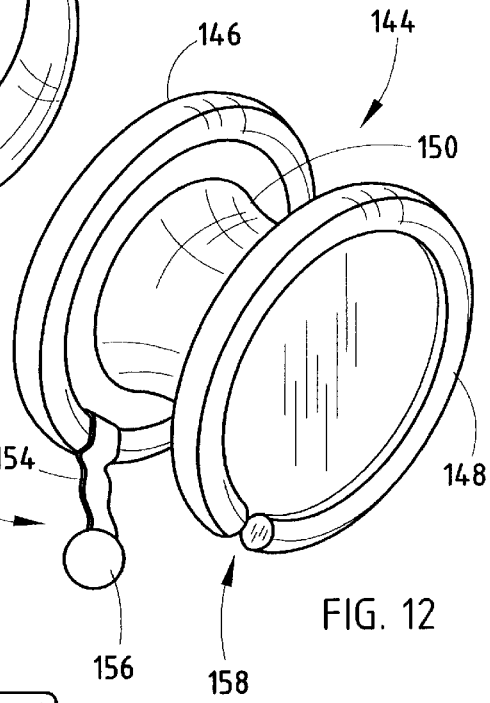
FIG. 12 is a perspective view of a second wire management device embodying an amenity of the present invention.
Figure 11B:
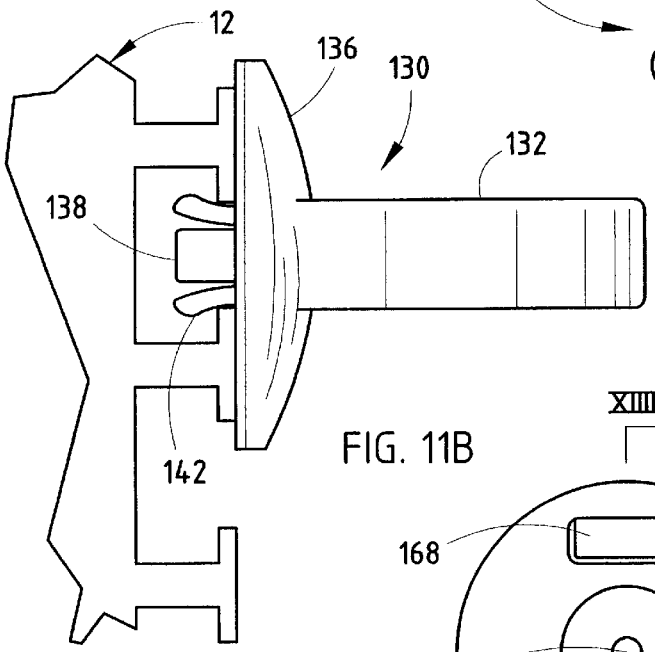
FIG. 11B is a side elevational view of the first wire management device supported by slat wall in a horizontal orientation.

As illustrated, the plurality of flexible fingers includes four flexible fingers 138 integrally formed with and outwardly extending from stem section 136. Fingers 138 are each inwardly flexible and include a flared end 142 that engage within slat wall 12, thereby assisting in holding wire management apparatus 130 into engagement within slat wall 12. In the illustrated example, the four fingers 138 are configured so as to allow loop section 132 to be supported by slat wall 12 in a horizontal orientation, as shown in FIG. 11A, and in a vertical orientation, as shown in FIG. 11B. It should be noted that different numbers and orientations of fingers 138 may be used, thereby allowing loop section 132 to be supported from slat wall 12 in numerous orientations. By allowing gap 140 of loop section 130 to be placed in various orientations, wire retention mechanism 130 may be positioned upon and supported from slat wall 12 such that any forces being exerted upon the lines can be directed away from gap 140, thereby ensuring that the lines stay within loop section 130 and are not accidentally removed or pulled therefrom.

The reference 144 (FIG. 12) generally designates a second wire management apparatus embodying an amenity unit of the present invention. In the illustrated example, wire management apparatus 144 includes a first plate 146, a second plate 148, and a narrowed center section or hub 150 connected to and extending between first plate 146 and second plate 148. First plate 146 and second plate 148 are connected to center section 150 such that first plate 146 and second plate 148 are substantially parallel to one another. Center section 150 is adapted to windingly receive electrical and communication lines typically associated with computers and communication equipment thereabout. Wire management apparatus 144 also includes a plurality of flexible fingers (not shown) similar in construction and configuration to fingers 138 (FIG. 10) of wire management apparatus 130, thereby allowing the wire management apparatus 144 to be removably mounted to slat wall 12.

The wire management apparatus 144 also includes a retaining mechanism 152 to prevent the unwinding of the electrical and communication lines from about center section 150. Retaining mechanism 152 includes and elastically deformable cord 154 attached to first plate 146 and including a stop 156. When in use, an electrical cord or communication line is wrapped about center section 150 and stop 156 of retaining mechanism 152 is notched within a notched section 158 within second plate 148, thereby extending cord 154 between first plate 146 and second plate 148 and preventing the electrical or communication line for being unwound from around center section 150.

Figure 13A:
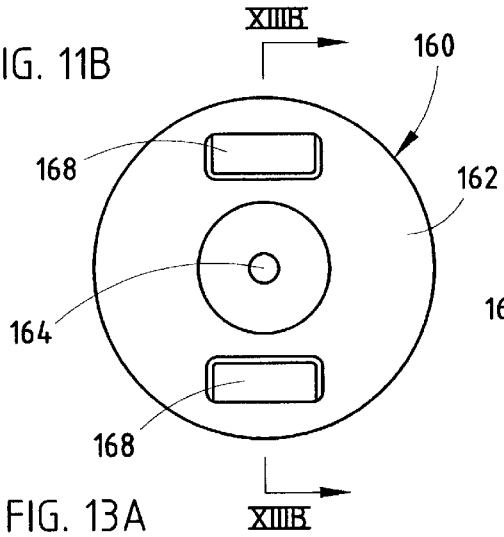
FIG. 13A is a rear elevational view of a mounting bracket.
Figure 13B:
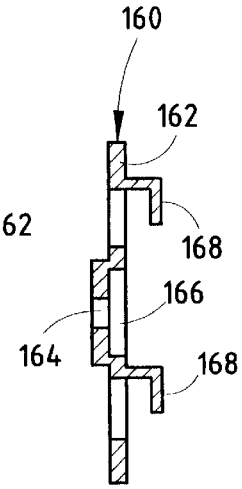
FIG. 13B is a cross-sectional view of the mounting bracket, shown through lines XIIIB—XIIIB of FIG. 13A.
Figure 14:
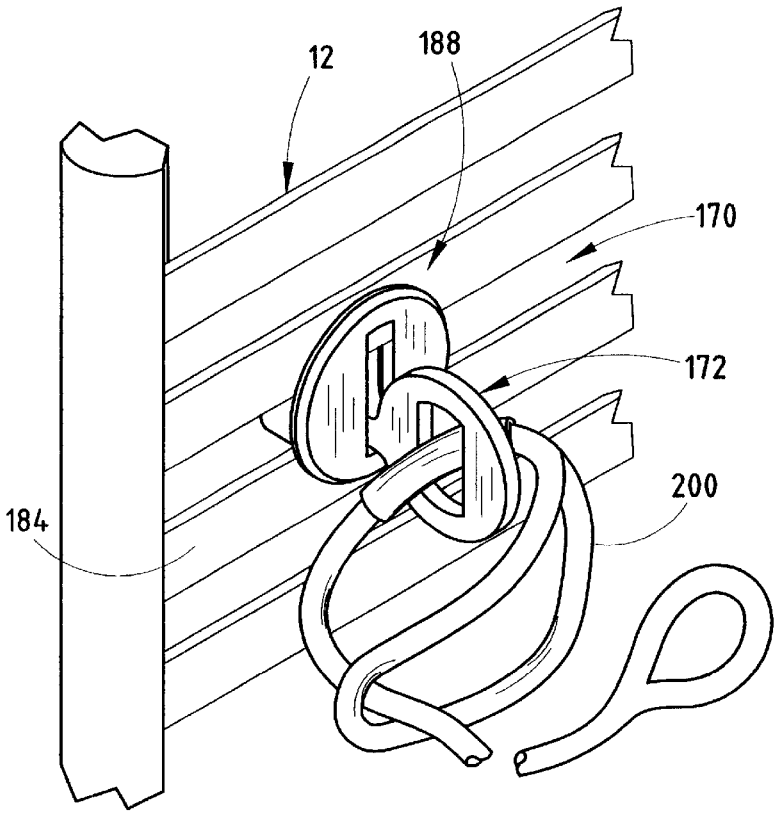
FIG. 14 is a perspective view of a security device embodying an amenity unit of the present invention supported by the slat wall.

In an alternative embodiment, a mounting plate 160 (FIGS. 13A and 13B) may be used to support wire management apparatus 130 (FIG. 10) and wire management apparatus 144 (FIG. 12) from slat wall 12 in place of the plurality of fingers 138. Mounting plate 160 is provided a circularly shaped plate section 162 having a centrally located aperture 164 adapted to receive mounting hardware such a bolt (not shown) therein, and a centrally located recessed area 166 surrounding aperture 164 and adapted to receive the head of the mounting hardware therein. Mounting plate 160 also includes a pair of L-shaped mounting flanges extending outwardly from plate section 162 and juxtaposed across aperture 164 and recessed area 166. In assembly, mounting plate 160 is secured to stem section 136 of wire management apparatus 130, or first plate 146 of wire management apparatus 144, in place of fingers 138, and is secured thereto by mounting hardware such as bolt or screw (not shown) extending through aperture 164 of mounting plate 160, or by a securing tape such as a double sided foam tape. In operation, mounting plate 160 supports wire management apparatus 130 and wire management apparatus 144 from slat wall 12 by inserting and engaging flanges 168 with slat wall 12. It should be noted that mounting plate 160 may be used to support various amenities from a slat wall, including, but not limited to, wire management devices, USB ports, power strips, shelving units and the like.

Figure 15A:
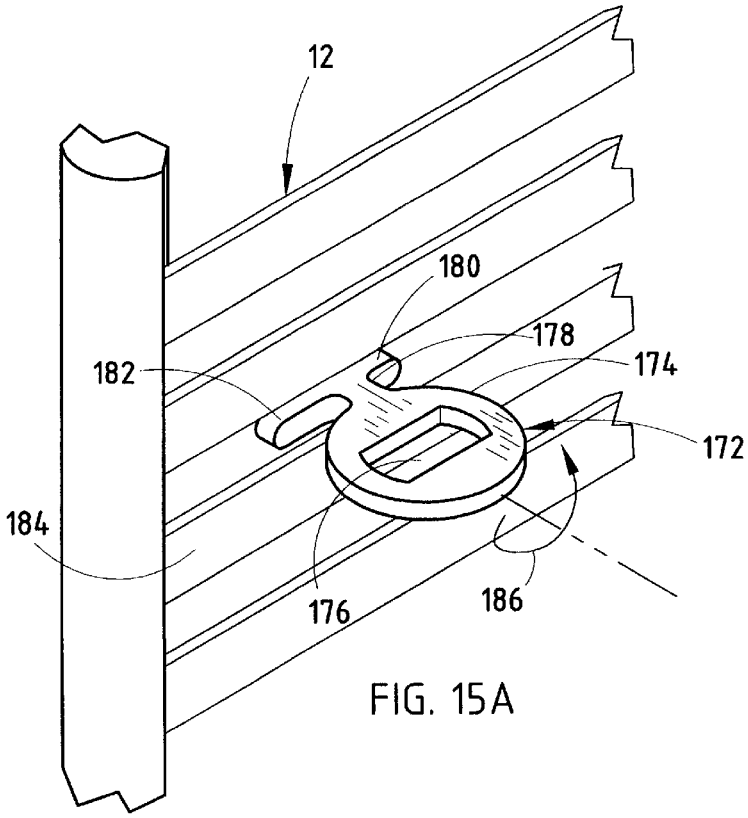
FIG. 15A is a perspective view of a first member of the security device inserted within the slat wall.
Figure 15B:
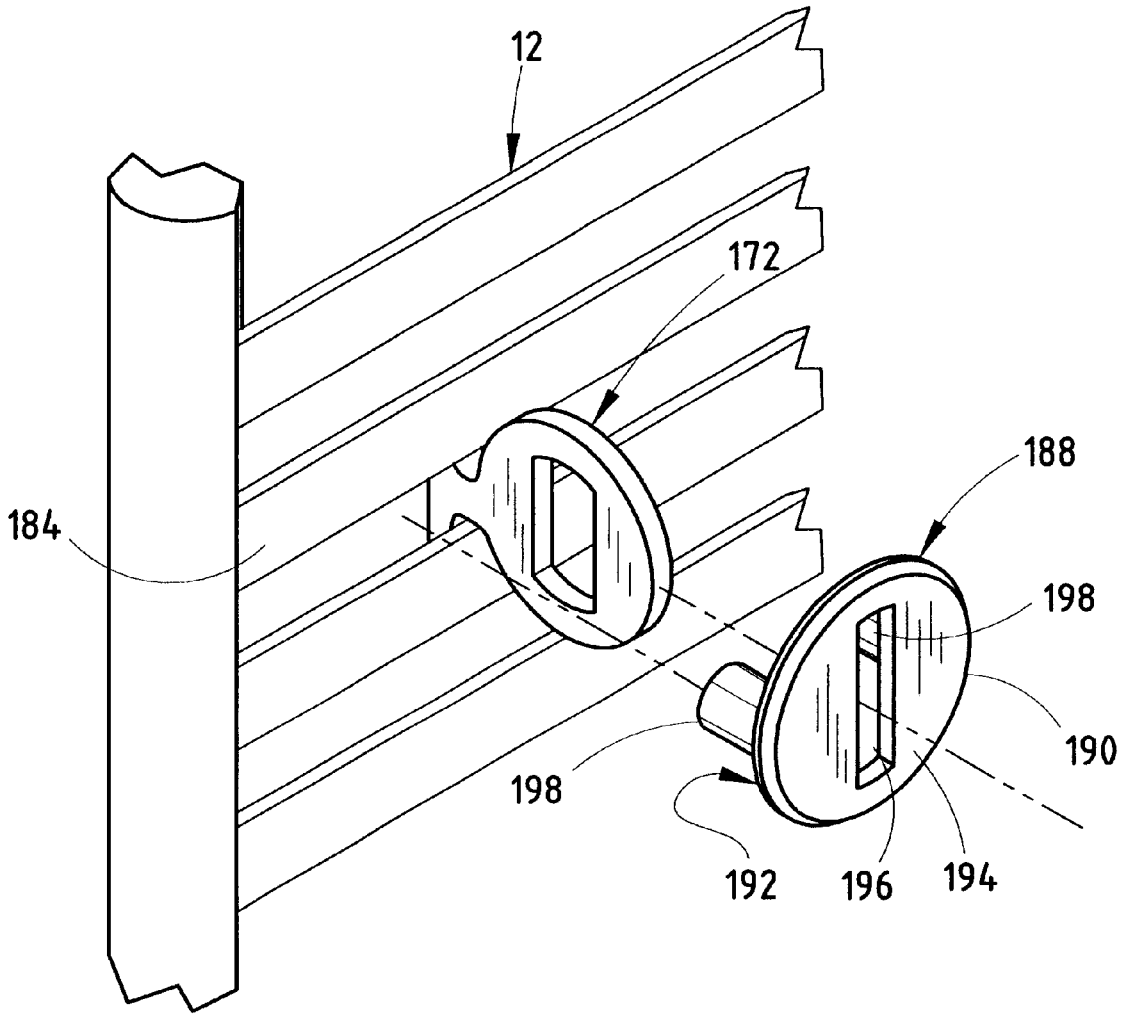
FIG. 15B is an exploded, perspective view of the first member and a second member of the security device.

The reference numeral 170 (FIG. 14) generally designates an apparatus for securing a device embodying an amenity unit of the present invention. In the illustrated example, the apparatus 170 is removably mountable to slat wall 12 and includes a first member 172 (FIG. 15A) that includes a ring section 174 defining a first aperture 176 therein, and a stem section 178 extending outwardly from ring section 174. First member 172 also includes a first flange 180 and a second flange 182 attached to stem section 178 and adapted to engage slat wall 12 by inserting flanges 180 and 182 within a slot 184 of slat wall 12 and rotating first member 172 in a rotational direction as shown by arrow 186. Apparatus 10 also includes a second member 188 (FIG. 15B) that includes a plate section 190 defining an inner surface 192 and an outer surface 194 and having an elongated aperture 196 located therein. The aperture 196 is adapted to receive ring section 174 of first member 172 therein. Second member 188 also includes a pair of stops 198 extending outwardly from inner surface 192 of plate section 190 and which are adapted to engage slot 184 of slat wall 12. In assembly, subsequent to first member 172 being rotationally engaged in slot 184 of slat wall 12, second member 188 is placed over first member 172 such that ring section 174 of first member 172 extends through aperture 196 of second member 188 and stops 198 are located within 184 of slat wall 12. Aperture 96 of second member 188 is configured so as to engage ring section 174 of second member 172, thereby restricting rotational movement of first member 172 within second member 188. Apparatus 170 further includes a third member 200 adapted to be received within aperture 176 of ring section 174, thereby preventing removal of second member 188 from about first member 172. In the illustrated example, third member 200 is shown as a security cable, however, other items may be placed within aperture 176 to prevent the removal of second member 188 from about first member 172.

Figure 17:
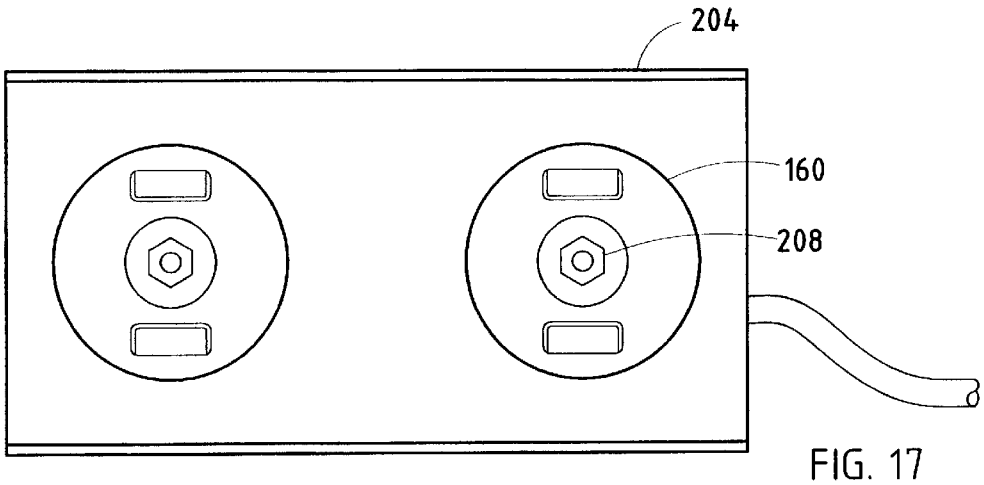
FIG. 17 is a rear elevational view of the power supply box.

The reference numeral 202 (FIG. 16) generally designates a power supply box embodying an amenity unit of the present invention. In the illustrated example, the power supply box 202 is removably mountable to a slat wall 12 and includes a housing 204, at least one power outlet 206 housed within housing 204, and at least one mounting bracket 160 (FIGS. 13A and 17) attached to housing 204 which is adapted to releasably engage slat wall 12 as described above, thereby supporting housing 204 on slat wall 12. As illustrated, bracket 160 is fixedly attached to housing 204 by a bolt 208, however, other fastening hardware and techniques may be employed. Housing 204 of power supply box 202 is provided with a triangular cross-sectional geometry, thereby providing increased access to the power supply outlets 206 when housing 204 is supported on slat wall 12.

The plurality of amenity units disclosed herein provide an effective means for organizing compact work areas by utilizing area within the work area heretofore unutilized. The plurality of amenity units are also easily movable between different work areas and easily adaptable to work areas of various layouts. Further, the plurality of amenity units provide an effective means for creating and maintaining an aesthetically pleasing and efficient work area.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A shelf removably mountable on a substantially vertical wall, comprising:

a worksurface defining a top surface configured to support a laptop computer thereon, and a rear edge;

at least one mounting member attached to the shelf and releasably mountable to the wall;

a recessed area located below the top surface of the worksurface, and adapted to receive wiring associated with the laptop computer therein;

a top cover movable between a closed position wherein the top cover covers the recessed area and is substantially planar with the top surface, and an open position wherein the recessed area is accessible;

a rear cover extending along the rear edge of the worksurface, the rear cover movable between a closed position wherein the rear cover forms a pocket with the worksurface, and an open position wherein the pocket is accessible; and a locking mechanism that engages the slat wall, thereby preventing the removal of the mounting member from the slat wall.

2. The shelf of claim 1, wherein the worksurface includes a first side edge and a second side edge, and wherein the shelf further includes a pair of stops slidably engaging the side edges of the worksurface, and adapted to restrict lateral movement of the laptop computer across the top surface of the worksurface.

3. The shelf of claim 2, wherein the top surface of the worksurface includes an area to manipulate a computer mouse thereon.

4. The shelf of claim 3, wherein the top cover is pivotally attached to the worksurface.

5. The shelf of claim 4, wherein the worksurface further includes a pair of posts extending upwardly from the top surface and juxtaposed across the recessed area, and wherein the rear cover is pivotally attached to the posts.

6. The shelf of claim 5, wherein the recessed area includes at least one substantially vertically oriented rib configured to allow organization of wiring within the recessed area.

7. The shelf of claim 6, wherein the recessed area further includes at least two substantially parallel pins configured to allow wrapping of wiring thereabout within the recessed area.

8. The shelf of claim 7, wherein the recessed area further includes a lower surface having an aperture adapted to receive the wiring therethrough.

9. The shelf of claim 8, wherein the shelf is mountable to a slat wall section and the locking mechanism includes a pair of tabs slidably engaging the worksurface, and slidable between a locked position wherein the tabs engage the slat wall preventing the removal of the mounting member from the slat wall, and an unlocked position wherein the tabs are disengaged from the slat wall and the mounting member may be removed from engagement with the slat wall.

10. The shelf of claim 9, wherein the worksurface includes notches extending along the rear edge, the notches adapted to receive the wiring therein.

11. The shelf of claim 10, wherein the top surface of the worksurface includes an ergonomically rounded forward section.

12. The shelf of claim 11, wherein the worksurface further includes a bottom surface and wherein the bottom surface includes outwardly extending structural support ribs.

13. A shelf removably mountable on a substantially vertical slat wall, comprising:

a worksurface defining a top surface configured to support a laptop computer thereon, and a rear edge;

at least one mounting member attached to the shelf and releasably mountable to the wall;

a recessed area located below the top surface of the worksurface, and adapted to receive wiring associated with the laptop computer therein;

a top cover movable between a closed position wherein the top cover covers the recessed area and is substantially planar with the top surface, and an open position wherein the recessed area is accessible; and a locking mechanism that engages the slat wall, thereby preventing the removal of the mounting member from the slat wall.

14. The shelf of claim 13, wherein the locking mechanism includes a pair of tabs slidably engaging the worksurface, and slidable between a locked position wherein the tabs engage the slat wall preventing the removal of the mounting member from the slat wall, and an unlocked position wherein the tabs are disengaged from the slat wall and the mounting member may be removed from engagement with the slat wall.

15. A kit for securing a device to a slat wall, comprising:

a first member including:

a ring section defining an aperture therein;

a stem section extending outwardly from the ring section; and a pair of flanges connected to the stem section and engageable with a slat wall by inserting the flanges within a slot of the slat wall and rotating the first member with respect to the slat wall;

a second member including:

plate section defining an inner surface and an outer surface and having an elongated aperture located therein, the aperture adapted to receive the ring section of the first member therein such that the ring section of the first member extends substantially orthogonal to the slat wall and the plate section extends substantially coplanar with the slat wall; and at least one stop extending outwardly from the inner surface of the plate section and adapted to engage the slat wall, thereby restricting rotational movement of the first and second members; and a third member adapted to be received within the ring section of the first member, thereby preventing removal of the plate of the second member from about the ring section of the first member.

16. The kit of claim 15, wherein the at least one stop of the second member includes two stops juxtaposed across the aperture of the plate section.

17. The kit of claim 16, wherein the third member is a security cable configured to connected to a device to be secured to the slat wall.

18. In a furniture system for dividing open office space and the like of the type having at least one vertical wall panel, the improvement of a wall-hung portable computer support shelf comprising:

a horizontal shelf member shaped to support a portable computer on an upper surface thereof;

a connector member detachably mounting said shelf member to said wall panel along a rear edge of said shelf member to support the same from said wall panel in a cantilevered horizontal orientation;

a wire trough extending laterally along said shelf member adjacent said rear edge thereof, and shaped to receive and retain therein wiring associated with the portable computer; and a removable cover shaped to enclose said wire trough and being detachably connected with said shelf member to provide access to said wire trough; and wherein said wall is a slat wall section and said computer shelf further includes a locking mechanism that engages said slat wall, thereby preventing the removal of said connector member from said slat wall.

* * * * *

UNITED STATES PATENT AND TRADEMARK OFFICE

CERTIFICATE OF CORRECTION

PATENT NO. : 6,578,498 B1
DATED : June 17, 2003
INVENTOR(S) : Draudt et al.

It is certified that error appears in the above-identified patent and that said Letters Patent is hereby corrected as shown below:

Title page,
Item [57], ABSTRACT,
Line 9, “mange” should be -- manage --.
Line 16, “devices” should be -- device --.
Line 17, delete “and”.
Line 20, delete “and”.

Column 1,
Line 44, “on” should be -- one --.
Line 48, “abutting” should be -- abuttingly --.
Line 50, “including” should be -- includes --.

Column 3,
Line 29, before “elevational” insert -- rear --.
Line 43, before “slat” insert -- the --.

Column 4,
Line 16, “general” should be -- generally --.

Column 5,
Line 38, “bottom wall 30” should be -- bottom wall 38 --.

Column 6,
Line 61, “a” should be -- an --.

Column 7,
Line 7, “show” should be -- shown --.
Line 34, “received” should be -- receive --.

Column 8,
Line 31, “and” should be -- an --.
Line 46, after “such” insert -- as --.

UNITED STATES PATENT AND TRADEMARK OFFICE

CERTIFICATE OF CORRECTION

PATENT NO. : 6,578,498 B1
DATED : June 17, 2003
INVENTOR(S) : Draudt et al.

It is certified that error appears in the above-identified patent and that said Letters Patent is hereby corrected as shown below:

Column 9,
Line 22, after "within" insert -- slot --.

Column 11,
Line 27, before "plate" insert -- a --.

Signed and Sealed this

Fourteenth Day of October, 2003

JAMES E. ROGAN
*Director of the United States Patent and Trademark Office*